United States Patent [19]

Shoji et al.

[11] Patent Number: 5,051,760

[45] Date of Patent: Sep. 24, 1991

[54] DIRECT IMAGE RECORDING APPARATUS USING TONER

[75] Inventors: Hisashi Shoji, Kawasaki; Makoto Obu, Yokohama; Hidetoshi Yano, Yokohama; Shinsuke Kikui, Yokohama; Junichi Terai; Tomoko Ogawa, both of Tokyo, all of Japan

[73] Assignee: Ricoh Company, Ltd., Tokyo, Japan

[21] Appl. No.: 559,210

[22] Filed: Jul. 30, 1990

[30] Foreign Application Priority Data

Jul. 31, 1989 [JP] Japan ..... 1-196773

[51] Int. Cl.[5] ..... B41J 2/01; B41J 2/175

[52] U.S. Cl. ..... 346/140 R

[58] Field of Search ..... 346/140, 153.1, 155; 118/654, 653; 355/249, 264

[56] References Cited

U.S. PATENT DOCUMENTS 4,164,746 8/1979 Anselrode ..... 346/140

4,431,296 2/1984 Haneda ..... 355/249

4,717,926 1/1988 Hotomi ..... 346/140

4,962,723 10/1990 Hotomi ..... 118/654

*Primary Examiner*—Joseph W. Hartary

*Attorney, Agent, or Firm*—Oblon, Spivak, McClelland, Maier & Neustadt

[57] ABSTRACT

An image recording apparatus for recording an image directly on a recording medium by transferring a toner to the medium. The toner is caused to fly toward the medium by small energy to form a high resolution image. A developing roller transports the toner in a predetermined direction. A flat electrode is located in the vicinity of the developing roller. A control electrode is provided on the flat electrode at a position where the flat electrode is remotest from the developing roller, while being electrically insulated from the flat electrode. The control electrode is made up of a number of recording electrodes and has an opening through which the toner may fly toward the medium.

6 Claims, 3 Drawing Sheets

DIRECT IMAGE RECORDING APPARATUS USING TONER

BACKGROUND OF THE INVENTION

The present invention relates to a non-impact type image recording apparatus and, more particularly, to an image recording apparatus capable of forming an image directly on a plain paper sheet or similar recording medium by use of a powdery toner.

Typical of image recording apparatuses of the type producing hard copies by using a powdery toner are a copier, facsimile machine and laser beam printer which are implemented with an electrophotographic procedure. Specifically, this kind of apparatus has an image carrier in the form of a photoconductive element. The photoconductive element is illuminated imagewise to electrostatically form a latent image thereon. The latent image is developed by a powdery toner, and the resulting toner image is transferred to a recording medium such as a plain paper sheet. The toner image on the recording medium is fixed to complete a recording. In the electrophotographic copier, the imagewise illumination is effected by light which is reflected from or transmitted through a document while, in the laser beam printer, it is effected by a laser beam or an LED (Light Emitting Diode) beam having been modulated by a digital signal. The electrophotographic procedure not only realizes high density and high resolution images but also promotes the use of various kinds of recording media as well as high-speed recording. However, such a procedure is not practicable without resorting to a complicated, bulky and expensive construction, i.e., complicated and accurate optics, photoconductive element which needs intricate management over various physical characteristics thereof, device for transporting a recording medium, a device for transferring a toner image to a recording medium, a device for cleaning the photoconductive element, a drive mechanism which has to drive the entire apparatus with accuracy, etc.

A so-called direct recording system proposed in the past is constrastive to the electrophotographic procedure stated above in that it selectively transfers a toner directly to a recording medium to form a toner image thereon, thereby eliminating the need for optics, photoconductive element, image transferring device, etc. For example, Japanese Patent Laid-Open Publication No. 176655/1983 discloses an apparatus in which a number of needle-like electrodes, a control plate having an opening, and a toner carrier are arranged in this order at intervals. In the apparatus disclosed in this Laid-Open Publication, a recording medium is transported with the back thereof being positioned in close proximity to or in contact with the recording electrodes, while an oscillating electric field is developed between the control plate and the toner carrier to activate a toner. A signal voltage is selectively applied to the recording electrodes to cause the activated toner to fly through the opening of the control plate toward the recording medium. Presumably, the words "activated toner" refer to those toner particles which are moving back and forth, or reciprocating, between the toner carrier and the control plate due to the oscillating electric field. To realize such a condition, it is necessary that the oscillating electric field developed between the control plate and the toner carrier be extremely intense. This in turn requires that a signal voltage intense enough to overcome such an oscillating electric field be applied to the recording electrodes. Otherwise, it would be impossible to transfer the toner in the above condition to a recording medium while controlling its movement and, therefore, to achieve an image with a great S/N ratio. However, such an intense signal voltage is apt to cause discharge to occur between nearby recording electrodes. Should the recording electrodes be located at greater intervals to eliminate the discharge, the resolution would be lowered.

Another image recording apparatus adopting the direct recording system is taught in U.S. Pat. No. 4,431,296. This apparatus is constructed such that an alternating electric field is developed between charging members which are located to face each other, and a developer flies in the space between the charging members.

SUMMARY OF THE INVENTION

It is therefore an object of the present invention to provide an image recording apparatus which records a high-resolution toner image directly on a recording medium by sufficiently activating, with small energy, a toner before the flight thereof to the medium and thereby controlling the flight with ease.

It is another object of the present invention to provide a generally improved image recording apparatus.

An image recording apparatus for recording an image directly on a recording medium by use of a developer of the present invention comprises a developer carrier for transporting the developer in a predetermined direction while carrying it thereon, a flat electrode located in close proximity to the developer carrier and extending away from the developer carrier in the predetermined direction, and a control electrode provided on the flat electrode at a position where flat electrode is remotest from the developer carrier and electrically insulated from the flat electrode. The flat electrode comprises a number of recording electrodes arranged side by side perpendicularly to the predetermined direction. The recording electrodes have an opening though which a part of the developer for recording an image may fly toward the recording medium.

BRIEF DESCRIPTION OF THE DRAWINGS

The above and other objects, features and advantages of the present invention will become more apparent from the following detailed description taken in conjunction with the accompanying drawings in which.

DESCRIPTION OF THE PREFERRED EMBODIMENTS

The principle of the present invention will be described first, with reference to FIGS. 1 to 3.

Figure 1:
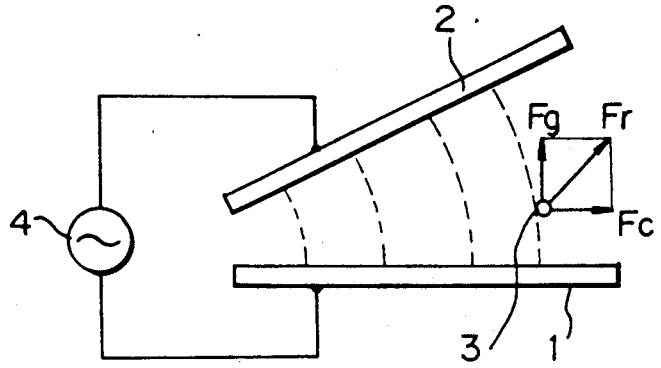
FIGS. 1 to 3 are schematic views useful for understanding the principle of the present invention.

As shown in FIG. 1, assume that an oscillating voltage is applied between a pair of electrodes 1 and 2 from an AC power source 4. Then, at a certain time, concentric electric lines of force are developed between the electrodes 1 and 2, as indicated by dotted lines in the figure. A toner 3 which is a charged particle is subjected to an electrostatic force along the electric lines of force. Assume that a force tending to pull the toner 3 toward the electrode 2 is acting on the toner 3. Then, a force Fg acts on the toner 3 in the direction of the electric lines of force due to the electric field. As a result, the toner 3 is moved along the electric lines of force and, therefore, effected by a centrifugal force Fc away from the electric lines of force. The resultant Fr of the forces Fc and Fg generates in the toner 3 a component which moves the toner 3 outward away from the concentric electric lines of force. If the electric field developed between the electrodes 1 and 2 oscillates, the forces Fc and Fb, i.e., the resultant Fr will change every moment. Nevertheless, the resultant Fr is directed outward away from the concentric electric lines of force all the time. Hence, the toner 3 moves in the direction in which the distance between the electrodes 1 and 2 increases, while oscillating between the latter.

Figure 2:
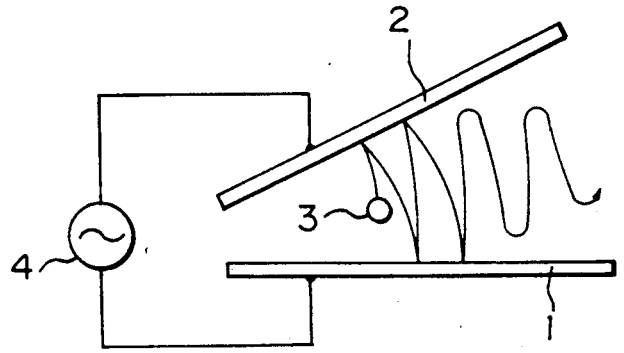

FIG. 2 shows the locus of the toner 3 which is positioned between the electrodes 1 and 2. In the position where the electrodes 1 and 2 are close to each other, even a relatively low voltage is sufficient to generate an intense electric field therebetween and, therefore, it is easy to cause the toner 3 to hit against the opposite electrodes 1 and 2. The toner 3 moves in the direction in which the distance between the electrodes 1 and 2 increases, due to the previously stated principle. By adequately selecting the oscillating voltage applied between the electrodes 1 and 2, it is possible to cause the toner 3 to travel while oscillating between the electrodes 1 and 2 or to travel without, in at least a part of the space between the electrodes 1 and 2, hitting against the electrodes 1 and 2. Concerning the latter case, as the distance between the electrodes 1 and 2 increases until the electric field becomes less intense than a certain value, the toner 3 is pulled back toward one electrode before reaching the other electrode and, therefore, does not contact the electrodes any further. Nevertheless, the toner 3 moves in the flaring direction of the electrodes 1 and 2 while oscillating therebetween.

Figure 3:
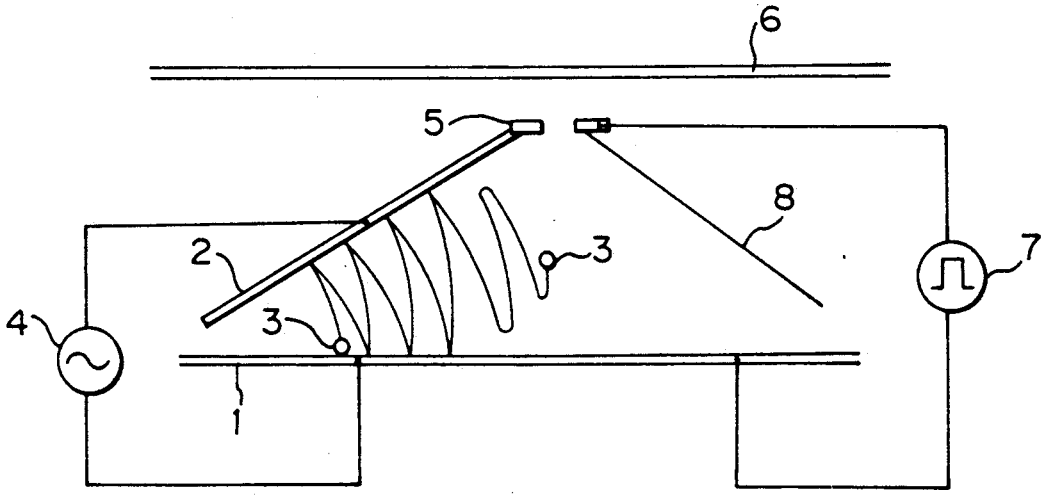

FIG. 3 is a section showing the basic construction of the image recording apparatus of the present invention. As shown, the toner 3 is carried on a developer carrier 1 which serves as one of the above-mentioned electrodes 1 and 2. The developer carrier 1 transports the toner 3 in one direction. A flat electrode 2 serving as the other electrode is inclined relative to the developer carrier 1 in such a manner as to extend away from the latter in an intended direction of toner transport. A control electrode 5 is provided on the rear end of the electrode 2 while being insulated from the latter. The control electrode 5 extends perpendicularly to the sheet surface of FIG. 3. A recording medium 6 is located at the opposite side to the developer carrier 1 with respect to the control electrode 5. A power source 4 applies an oscillating voltage between the developer carrier 1 and the electrode 2.

The toner 3 entered the space between the developer carrier 1 and the flat electrode 2 is moved, by the aforementioned principle, in the flaring direction of the developer carrier 1 and electrode while moving back and force perpendicularly to the surface of the developer carrier 1. Specifically, the toner 3 oscillates between the developer carrier 1 and the flat electrode 2 or, as the distance between the developer carrier and the electrode 2 increases to a certain extent, floats in the space while oscillating, depending on the oscillating voltage. As a result, such toner particles float in the vicinity of the control electrode 5 in the form of a cloud, while oscillating perpendicularly to the surface of the developer carrier 1. In this condition, an image signal applying device 7 feeds to the control electrode 5 a signal voltage which draws the toner 3 toward the control electrode 5 and transfers it to the recording medium 6 via the control electrode 5. Since the toner 3 is in the form of a cloud as mentioned above, a relatively low signal voltages suffices for the toner 3 to be deposited on the surface of the recording element 6 via the control electrode 5.

Assume that the control electrode 1 is implemented as a number of recording electrodes which are arranged side by side in the lengthwise direction of the electrode 1. Then, it is possible to form a toner image directly on the recording element 6 by selectively applying a voltage to the recording electrodes to control the flight of toner particles toward the recording medium 6 over one scanning line, moving the medium 6 at a predetermined velocity, and repeating such an operation line by line. The toner particles left non-transferred to the medium 6 are moved to between the developer carrier 1 and a wall 8 and therefrom to the outside.

To summarize the principle of the present invention. described above, (1) the flat electrode 2 is inclined relative to the developer carrier 1, and an oscillating voltage is applied between the image carrier 1 and the electrode 2 to set up an oscillating electric field whose intensity sequentially decreases therebetween;

(2) the toner 3 is transported through such an electric field and thereby activated while moving back and forth in an oscillating motion; and (3) the balance of the electric field is disturbed to control the flight of the activated toner.

Preferred embodiments of the image recording apparatus in accordance with the present invention will be described hereinafter.

FIRST EMBODIMENT

Figure 4:
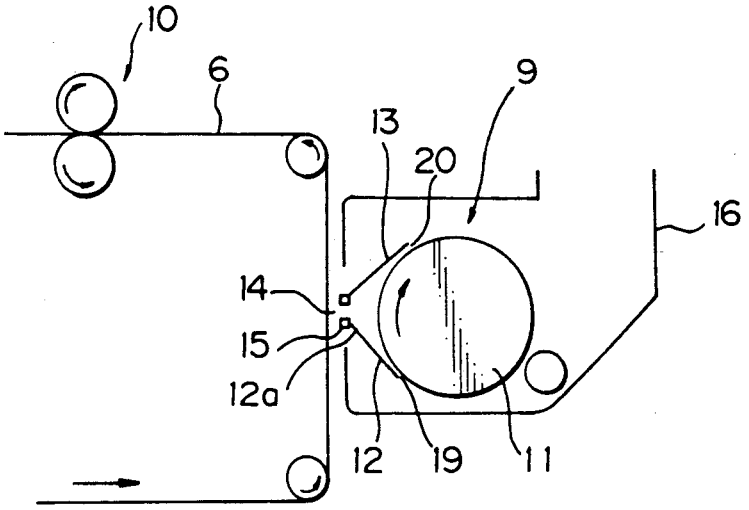
FIG. 4 is a sectional side elevation showing a preferred embodiment of the image recording apparatus in accordance with the present invention.

Referring to FIG. 4, an image recording apparatus embodying the present invention has transporting means for transporting a plain paper or similar recording medium 6. The transporting means includes a belt and rollers and transports the recording medium 6 from a paper feeding section, not shown, to a fixing section 10 by way of a toner image forming section 9. In the toner image forming section 9, toner particles accommodated in a toner hopper 16 are caused to fly imagewise to the medium 6. The fixing section 10 fixes the toner image on the medium 6 by applying heat or pressure thereto, as has been customary with electrophotography. The medium 6 come out of the fixing section 10 is driven out of the apparatus.

The toner image forming section 9 has a developing roller or developer carrier 11 and a first flat electrode 12 which extends away from the roller 11 in an intended direction of rotation of the roller 11. A control electrode 15 is positioned in close proximity to the end 12*a* of the electrode 12 which is remotest from the roller 11. A second flat electrode 13 is located downstream of the control electrode 15 and so oriented as to extend toward the roller 11 in the intended direction of rotation of the roller 11. An oscillating voltage is applied between the first flat electrode 12 and the roller 11. The second flat electrode 13 is electrically connected to the roller 11 to have the same potential as the latter. The control electrode 15 has an opening 14. The recording medium 6 is brought to the position where it faces the roller 11 through the opening 14 of the control electrode 15. The toner is caused to fly through the opening 14 to form an image on the medium 6.

Figure 5:
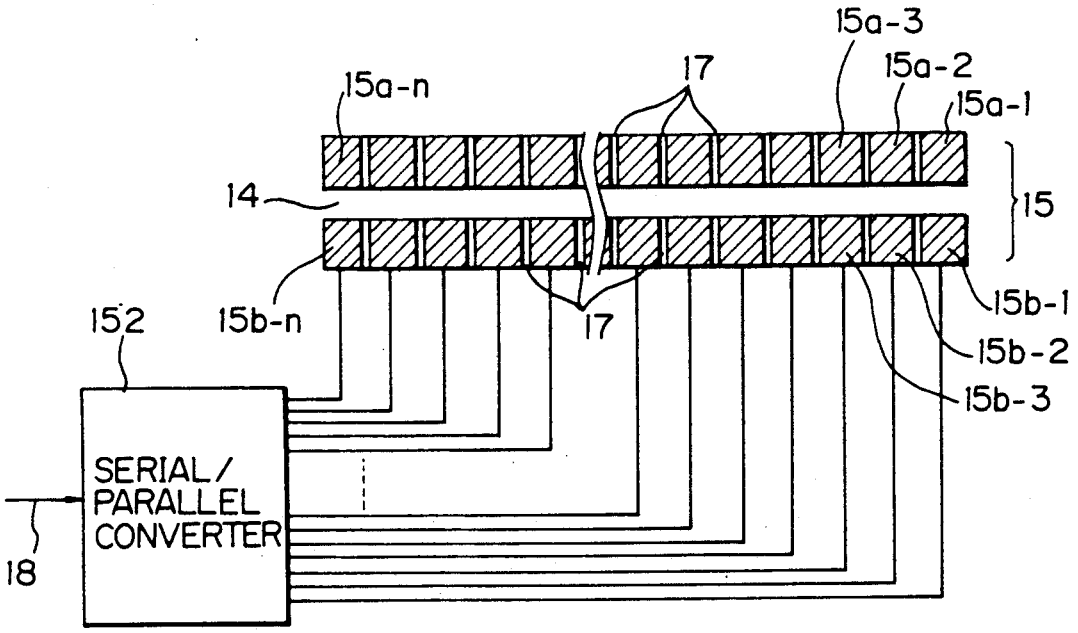
FIG. 5 is a section showing a specific construction of a control electrode included in the illustrative embodiment.

As shown in FIG. 5, the control electrode 15 is made up of a number of recording electrodes 15*a*-1 to 15*a-n* and 15*b*-1 to 15*b-n* which are arranged in two rows to cover one line of pixels. Specifically, the recording electrodes 15*a*-1 to 15*a-n* and the recording electrodes 15*b*-1 to 15*b-n* are spaced apart from each other by the opening 14 and associated one-to-one with each other. Each of the pairs of the recording electrodes 15*a*-1 and 15*b*-1, 15*a*-2 and 15*b*-2, . . . , 15*a-n* and 15*b-n* is held in electrical conduction. The recording electrodes 15*a*-1 to 15*a-n* or 15*b-a* to 15*b-n* in each array are insulated by insulating members 17. An image signal 18 is fed serially from an external input unit, not shown, to a serial-to-parallel (SP) converter 152. In response, the SP converter 152 transforms the serial image signal into parallel data line by line (scanning line). The parallel outputs of the SP converter 152 each is directly connected respective one of the recording electrodes 15*a*-1 to 15*a-n* and 15*b*-1 to 15*b-n*.

In operation, the toner is fed from the toner hopper 16 to the developing roller 11 to form a layer thereon. The roller 11 transports the toner to the space between itself and the flat electrode 12 via an inlet 19. Then, the toner advances in the moving direction of the roller 11 while hitting against the roller 11 and electrode 12, as stated earlier with reference to FIGS. 1 to 3. While so oscillating, the toner approaches the control electrode 15 in a cloud. As a voltage is selectively applied to the recording electrodes 15*a*-1 to 15*a-n* and 15*b*-1 to 15*b-n* of the control electrode 15 according to the image signal 18, the toner existing in the vicinity of the control electrode 15 is caused to fly toward the recording medium 6 via the opening 14. Such a flight of toner particles to the medium 6 readily occurs even if the signal voltage applied to the recording electrodes 15*a*1 to 15*a-n* and 15*b*1 to 15*b-n* is relatively low, since the toner particles are in the form of a cloud.

When the oscillating voltage applied between the developing roller 11 and the first flat electrode 12 is higher than a given voltage, the toner travels the space between the roller 11 and the electrode 12 while hitting against the roller 11 and electrode 12. On the other hand, when the oscillating voltage is lower than the given voltage or the frequency thereof is higher than a given frequency, the amplitude of oscillation of the toner is reduced so that the toner stops hitting against the roller 11 and electrode 12 in the vicinity of the control electrode 15, i.e., it simply moves in the space while oscillating perpendicularly to the surface of the roller 11. In this condition, the toner is floating in the space due to the balance of the electric field. When the voltage is selectively applied to the recording electrodes 15*a*-1 and 15*a-n* and 15*b*-1 and 15*b-n* according to the image signal 18, the balance of the electric field is disturbed to promote easier control over the movement of the toner.

The toner around the control electrode 15 is subjected to a driving force due to the rotation of the developing roller 11 and a driving force ascribable to the osci ing electric field. These driving forces act in the same direction as each other. When a non-recording signal is applied to any of the recording electrodes 15*a*-1 to 15*a-n* and 15*b*-1 to 15*b-n*, the toner around such an electrode is not electrically urged toward the opening 14 and is simply subjected to inertia due to the above-mentioned driving forces. As a result, this part of the toner continues to move in the same direction until the second flat electrode 13 acts on it. Since the electrode 13 has the same potential as the developing roller 11, the toner stops oscillating and is driven out through an outlet 20 due to the rotation of the roller 11.

In the above condition, a stationary state is set up in the toner image forming section 9 as to the flow of the toner.

Preferable conditions for practicing the illustrative embodiment are as follows.

Developer: An insulative toner should have a high resistance so that it might not be discharged while oscillating between opposite electrodes under the application of an AC voltage. The developer layer on the developing roller 11 should be as thin as possible and, therefore, a one-component developer is desirable.

Distance between roller 11 and electrodes 12 and 13: 50 to 500 microns in the nearest position (inlet 19 and outlet 20), and 200 to 1000 microns at the remotest position (opening 14)

Distance between roller 11 and medium 6: 300 to 3000 microns

Pitch of recording electrodes 15*a*1 to 15*a-n* or 15*b*-1 to 15*b-n*: 50 to 300 microns Velocity of medium 6: 50 to 500 millimeters per second Voltage applied to roller 11: zero volt (DC) and 0.5 to 3 kilovolts (pp) and 1 to 5 kilohertz (AC) (the DC voltage is positive or negative when the toner is charged positively or negatively)

Voltage applied to electrode 12: zero volt (DC)

Voltage applied to electrodes 15*a*-1 to 15*a-n* and 15*b*-1 to 15*b-n*: −10 to 10 volts in the event of recording, and 10 to 50 volts in the event of non-recording It is to be noted that the DC voltages mentioned above specifically are derived from the assumption that the toner is positively charged. If the toner is negatively charged, the polarity will be reversed.

SECOND EMBODIMENT

In the image recording apparatus shown in FIG. 4, a DC voltage tending to urge the toner toward the developing roller 11 is applied between the second flat electrode 13 and the developing roller 11. Specifically, the electrode 13 is applied with a voltage whose AC component is the same as that of the roller 11 and whose DC component is greater than that of the roller 11 by 100 to 500 volts. In this condition, the toner which has not flown to the recording medium 6 and has entered the range of the electrode 13 stops oscillating and is electrically urged toward the roller 11. This allows the toner image forming section 9 to transport the toner stably without causing the toner from being scattered around.

THIRD EMBODIMENT

Figure 6:
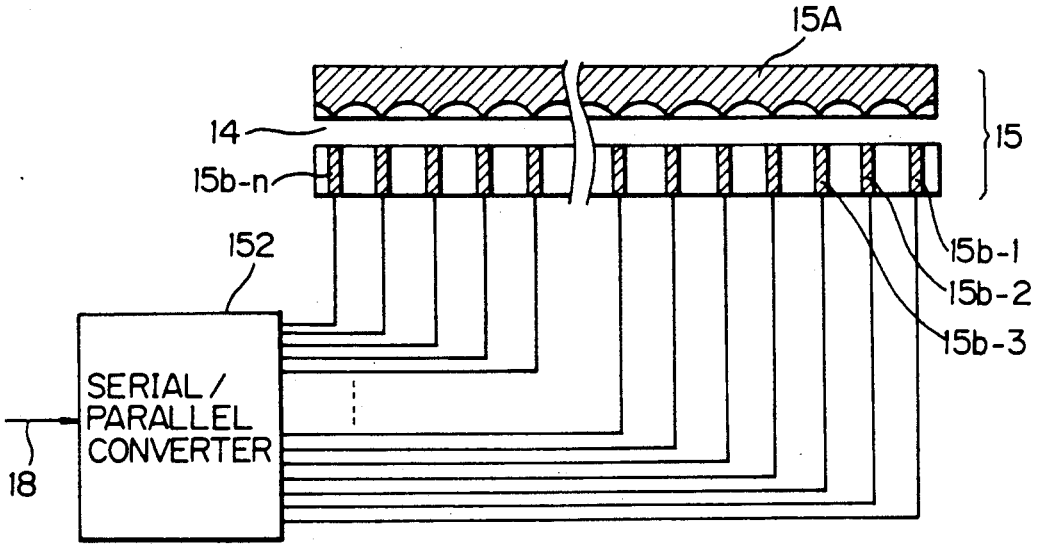
FIG. 6 is a view similar to FIG. 5, showing another specific construction of the control electrode.

The control elecrode 15 included in the apparatus shown in FIG. 4 is modified, as shown in FIG. 6. Specifically, the recording electrodes 15*a*-1 to 15*a-n* shown in FIG. 5 are replaced with a single common electrode 15A. The common electrode 15A faces the recording electrodes 15*b*-1 to 15*b-n* with the intermediary of the opening 14. A voltage matching the image signal 18 is selectively applied to the recording electrodes 15b-1 to 15b-n which are arranged side by side to cover one line of pixes. A constant voltage is applied to the common electrode 15A at all times. The image signal 18 is routed through the same path as in FIG. 5. The toner moves back and force between the developing roller 11 and the first flat electrode 12 or floats in the space therebetween, forming a toner cloud around the control electrode 15, as in the first embodiment. To transfer the toner to the recording medium 6, the common electrode 15A and the electrodes 15b-l to 15b-n are held at the same potential to prevent an electrostatic force from acting on the toner. To inhibit the transfer of the toner to the recording medium 6, a voltage is applied to the electrodes 15b-l to 15b-n such that an electrostatic force acts in the same direction as the direction in which the toner advances. Specifically, assuming that the electrodes 15b-l to 15b-n are located downstream of the common electrode 15A with respect to the direction of rotation of the roller 11, it is preferable that in a non-recording condition a voltage which draws the toner be applied to the electrodes 15b-l to 15b-n. This would be successful in controlling the transfer of the toner with smaller energy, i.e., by applying an external force perpendicularly to the oscillating direction of the toner.

Assuming the same conditions as in the first embodiment, it is preferable to apply a voltage of zero volt to the common electrode 15A and to apply to the recording electrodes 15b-l to 15b-n a voltage of zero volt in the event of recording and a voltage of 10 to 30 volts in the event of non-recording.

FOURTH EMBODIMENT

Figure 7:
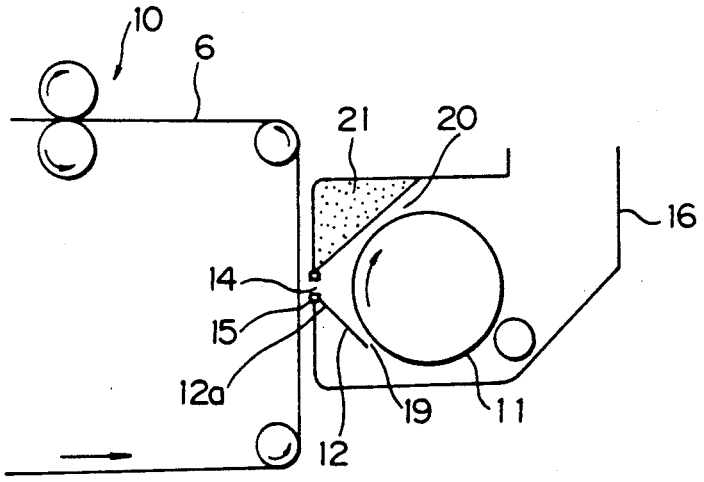
FIG. 7 is a sectional side elevation showing an alternative embodiment of the present invention.

FIG. 7 shows an image recording apparatus which is essentially similar to the apparatus shown in FIG. 4, except that is has an insulating member 21 in place of the second flat electrode 13. As shown, the insulating member 21 is generally configured in the same manner as the flat electrode 13. The toner travels the space between the developing roller 11 and the flat electrode 12 toward the control electrode 15 while oscillating perpendicularly to the surface of the roller 11, as in the first embodiment. When the balance of the electric field is disturbed by the recording electrodes of the control electrode 15, the toner flies toward the recording medium 6 via the opening 14. If the toner is not electrically urged toward the opening 14, it further advances in the moving direction of the roller 11 until it reaches the space between the roller 11 and the insulating member 21. The toner reached this space is free from the influence of the flat electrode 12 and, therefore, stops oscillating. As a result, the toner is transported in the moving direction of the roller 11 to the outside via the outlet 20.

In summary, the present invention achieves various unprecedented advantages as enumerated below.

(1) A toner image is directly formed on a recording medium with the transfer of a toner to the medium being controlled by small energy.

(2) A second flat electrode is located at the downstream side of a toner transport path to return the toner to a developer carrier, whereby the toner is prevented from being scattered around.

(3) The advantage (2) is also achievable when the second flat electrode is replaced with an insulating member.

(4) When use is made of an insulative toner, accurate control over the movement of the toner is promoted since the toner does not loose its charge during the course of oscillation.

Various modifications will become possible for those skilled in the art after receiving the teachings of the present disclosure without departing from the scope thereof.

What is claimed is:

1. An image recording apparatus for recording an image directly on a recording medium by use of a developer, comprising:

developer carrying means for transporting the developer in a predetermined direction while carrying said developer thereon;

a flat electrode located in close proximity to said developer carrying means and extending away from said developer carrying means in said predetermined direction; and a control electrode provided on said flat electrode at a position where said flat electrode is remotest from said developer carrying means, and electrically insulated from said flat electrode;

said flat electrode comprising a number of recording electrodes arranged side by side perpendicularly to said predetermined direction, said number of recording electrodes having an opening though which a part of the developer for recording an image may fly toward the recording medium.

2. An apparatus as claimed in claim 1, further comprising a power source for applying an oscillating voltage between said developer carrying means and said flat electrode.

3. An apparatus as claimed in claim 2, wherein the oscillating voltage has intensity which causes the developer to move in an oscillating motion between said developer carrying member and said flat electrode.

4. An apparatus as claimed in claim 2, wherein the oscillating voltage has intensity which causes the developer to move in an oscillating motion between said developer carrying member and said flat electrode without, in at least a part of a space between said developer carrying member and said flat electrode, hitting against said developer carrying member and said flat electrode.

5. An apparatus as claimed in claim 1, further comprising image signal applying means for selectively applying a voltage to said recording electrodes according to an image signal.

6. An apparatus as claimed in claim 1, further comprising medium transporting means for transporting the recording medium to a position where said recording medium faces said opening of said control electrode.

* * * * *